US007498514B2

(12) United States Patent
King, Jr.

(10) Patent No.: US 7,498,514 B2
(45) Date of Patent: Mar. 3, 2009

(54) MOLDED TWIST-ON WIRE CONNECTOR

(75) Inventor: L. Herbert King, Jr., Chesterfield, MO (US)

(73) Assignee: KWG Technology, O'Fallon, MO (US)

( * ) Notice: Subject to any disclaimer, the term of this patent is extended or adjusted under 35 U.S.C. 154(b) by 0 days.

(21) Appl. No.: 11/999,615

(22) Filed: Dec. 6, 2007

(65) Prior Publication Data

US 2008/0121409 A1 May 29, 2008

Related U.S. Application Data

(62) Division of application No. 11/157,123, filed on Jun. 20, 2005, now Pat. No. 7,351,369.

(60) Provisional application No. 60/581,603, filed on Jun. 21, 2004.

(51) Int. Cl.
*H01R 4/00* (2006.01)

(52) U.S. Cl. ..... 174/84 R; 174/87

(58) Field of Classification Search ..... 174/74 R, 174/76, 77, 82, 84 S, 84 C, 87; 439/521, 439/930

See application file for complete search history.

(56) References Cited

U.S. PATENT DOCUMENTS

| | | | | |
|---|---|---|---|---|
| 3,676,574 | A * | 7/1972 | Johansson et al. | 174/87 |
| 5,151,239 | A * | 9/1992 | King, Jr. | 264/272.11 |
| 6,025,559 | A * | 2/2000 | Simmons | 174/87 |
| RE37,340 | E * | 8/2001 | King, Jr. | 174/87 |
| 6,359,226 | B1 * | 3/2002 | Biddell et al. | 174/74 A |
| 6,478,606 | B1 * | 11/2002 | McNerney et al. | 439/415 |
| 6,730,847 | B1 * | 5/2004 | Fitzgerald et al. | 174/77 R |

* cited by examiner

*Primary Examiner*—William H Mayo, III
(74) *Attorney, Agent, or Firm*—Jacobson & Johnson

(57) ABSTRACT

A wire connector wherein the wire engaging core and electrically insulated housing are molded with an exterior surface of a molded wire engaging core used as a mold surface as the electrically insulated housing is molded around the wire engaging core to provide a wire connector with a molded housing and a molded wire engaging core.

5 Claims, 1 Drawing Sheet

MOLDED TWIST-ON WIRE CONNECTOR

CROSS REFERENCE TO RELATED APPLICATIONS

This application is a division of application Ser. No. 11/157,123 filed Jun. 20, 2005 now U.S. Pat. No. 7,351,369, titled MOLDED TWIST-ON WIRE CONNECTOR, which claims priority from U.S. provisional patent application Ser. No. 60/581,603 titled Molded Wire Connector filed Jun. 21, 2004.

FIELD OF THE INVENTION

This invention relates generally to molded electrical connectors and a method of making electrical connectors though a molding process and, more specifically, an electrical twist-on wire connector wherein the twist-on wire connector is formed of different materials with each of the materials molded in situ to form a twist-on electrical wire connector.

STATEMENT REGARDING FEDERALLY SPONSORED RESEARCH OR DEVELOPMENT

None

REFERENCE TO A MICROFICHE APPENDIX

None

BACKGROUND OF THE INVENTION

In the manufacture of electrical twist-on wire connectors a wire is wound into a spiral core and the spiral core is then inserted into a plastic or insulated housing. To protect the wire junction in the twist-on wire connector a sealant can be inserted into the spiral wire core. When the wires are inserted into the spiral core and twisted one forms a low resistance electrical connector therein. A twist-on wire connectors with a sealant is shown in my U.S. Pat. Nos. 5,113,037; 5,023,402 and 5,151,239.

The use of a wire that is shaped into a spiral thread for insertion into the insulating shell of the twist-on wire connector requires the steps of creating the wire from a raw metal, forming the wire into a spiral core by winding the wire around some type of support and cutting the wire to length. The spiral core can then transferred into an insulated plastic housing which is generally molded through an injection molding process. If the twist-on wire connector includes a sealant a sealant is injected into the spiral core of the twist-on wire connector once the insulating sleeve is positioned around the wire core. The concept of making a twist-on wire connector with a sealant therein is more thoroughly described in my U.S. Pat. No. 5,771,578.

The present invention eliminates the multi-processing required to form a typical twist-on wire connector through the process of molding a spiral core from an amorphous alloy often referred to as bulk metallic glass and then molding the electrical insulating housing around the amorphous alloy spiral core to enable the formation of a twist-on wire connector through a sequence of molding steps. In addition, if the twist-on wire connector is to contain a sealant the sealant can be injected into the cavity in the spiral core. Thus the process of formation of a twist-on wire connector can be formed entirely through a molding process thereby reducing the handling and assembling problems.

SUMMARY OF THE INVENTION

An electrical wire connector and method of making wherein an electrical wire engaging core of the wire connector comprises an amorphous alloy and the outer housing comprises an electrical insulating material with an electrical twist-on wire connector formable through a molding process wherein the core is molded from an amorphous alloy and the electrically insulating housing is molded around the core to enable a ready-to-use electrical connector to be formed through a molding process.

DESCRIPTION OF THE PREFERRED EMBODIMENT

Figure 1:
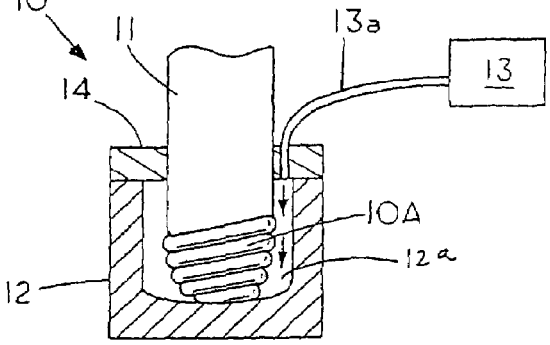
FIG. 1 shows a cross-sectional view of a mandrel having an end in the shape of female thread on a twist-on wire connector positioned in a mold as a liquid metal is injected into the mold.

FIG. 1 shows a cross-sectional view of a mandrel 11 having an end in the shape of female trade 12*a* for a spiral core for a twist-on wire connector. The mandrel 11 is positioned in a mold 12 having a lid 14 that surrounds the mandrel 11 and forms a cover thereon. A source of liquid metal 13 is injected into the mold cavity through line 13*a*. The liquid metal fills the opening and solidifies around the mandrel spiral thread 10*a*. The liquid metal used comprises an amorphous alloy with high yield strength and excellent definition. The amorphous alloys are describe in U.S. Pat. Nos. 5,288,344; 5,618,359 and 6,466,558 and are sold by amorphous technologies international corporation of California.

Figure 2:
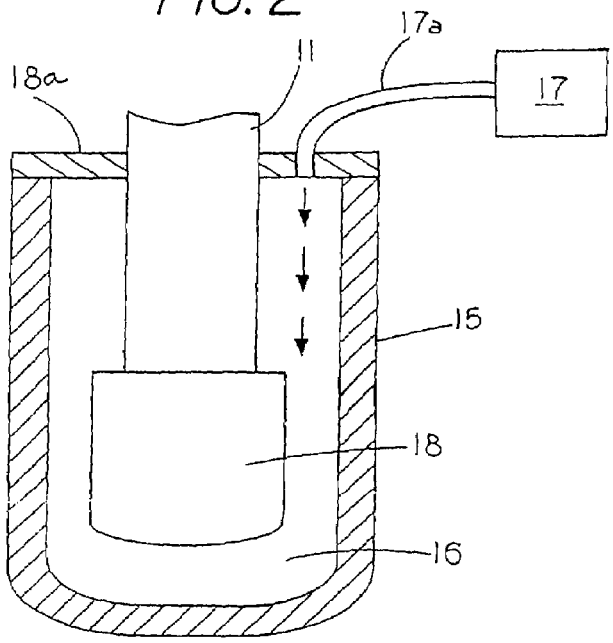
FIG. 2 show the solidified liquid metal core positioned in mold as an insulating plastic is injected molded around both the mandrel and the injection mold core.

FIG. 2 show the solidified wire engaging core which can be a spiral core 18 that has been injection molded positioned in mold cavity 16 formed by mold 15. A cover 18*a* extends over the top of the mold cavity 16. A source of an electrically insulating plastic 17 is shown connected to mold cavity 16 by a conduit 17*a* to allow one to injection mold the electrically insulating plastic around both the mandrel and the solidified wire engaging core 18.

Figure 3:
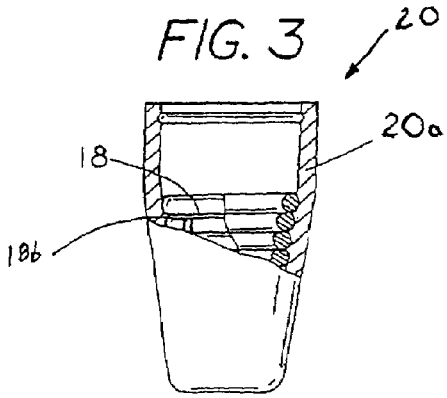
FIG. 3 shows a twist-on wire connector partially in section with the mandrel removed therefrom to leave a twist-on wire connector wherein both the insulated housing and the electrically conducting spiral core have been injected molded.

FIG. 3 shows a twist-on wire connector 20 partially in section with the mandrel removed therefrom to leave the injection molded spiral core 18 within the injection molded insulated housing 20.

In order to prevent rotation of the wire engaging member an external surface of the wire core can contains an irregularity 18*b* so that the electrically insulated material injected therearound mechanically engages the external surface irregularity 18*b* of the wire engaging core 18 to prevent rotation of the spiral core 18 with respect to housing 20.

Thus the twist-on wire connector of FIG. 3 has been formed by an injection molding of a liquid metal around a mandrel having a spiral end. After solidification of the spiral core around the mandrel the mandrel with the spiral core is placed in a further mold, as shown in FIG. 2, while an electrically insulated housing is injected molded around the Thus the method of the present invention comprises a method of making a twist-on wire connector 20 by forming a mold cavity 12*a* in a first mold 12 having an internal mold part 11 having a mold surface 10*a* in the shape of a female spiral thread. One can then inject a liquid metal 13 into the mold cavity 12*a* to form an electrically conducting spiral core 18.

Next, one removes the electrically conducting spiral core 18 from the mold cavity 12*a* while retaining the electrically conducting spiral core 18 on the internal mold part 11. In the next step one places the electrically conducting core in a second mold cavity 16 and injects an electrically insulating polymer plastic 17 into a second mold cavity 16 to cover an exterior surface 18*a* of the spiral core 18. One can them remove the internal mold part 11 from the second mold 15 while retaining the spiral core 18 therein to provide an injection molded twist-on wire connector 20 with an electrically conducting spiral core 18 and an external insulated housing 20.

While the present invention is shown in relation to forming a twist-on wire connector the present method is suitable for forming other electrical connectors that have two different materials forming the electrical connector.

The invention claimed is:

1. An electrical wire connector comprising:

a wire engaging surface comprising an amorphous alloy; and an electrically insulated housing surrounding the amorphous alloy to enable an electrical junction on the wire engaging surface to be electrically insulated from user contact through the electrically insulated housing thereon.

2. The electrical wire connector of claim 1 wherein the electrical connector comprises a twist-on wire connector and the wire engaging surface comprises a spiral thread surface.

3. The electrical wire connector of claim 2 wherein the electrical insulated housing comprises a polymer plastic.

4. The electrical wire connector of claim 3 wherein a sealant is located in the spiral thread.

5. The electrical wire connector of claim 1 wherein the electrical insulated housing comprises a polymer plastic.

* * * * *